US005970763A

United States Patent [19]

Takayama

[11] Patent Number: 5,970,763

[45] Date of Patent: Oct. 26, 1999

[54] TRANSFER PRESS

[75] Inventor: Yukiyoshi Takayama, Komatsu, Japan

[73] Assignee: Komatsu Ltd., Tokyo, Japan

[21] Appl. No.: 09/065,102

[22] PCT Filed: Jan. 8, 1997

[86] PCT No.: PCT/JP97/00048

§ 371 Date: Apr. 29, 1998

§ 102(e) Date: Apr. 29, 1998

[87] PCT Pub. No.: WO97/28913

PCT Pub. Date: Aug. 14, 1997

[30] Foreign Application Priority Data

Feb. 8, 1996 [JP] Japan ..... 8-022865

[51] Int. Cl.[6] ..... B21D 43/05; B21D 55/00

[52] U.S. Cl. ..... 72/1; 72/405.01; 72/405.16

[58] Field of Search ..... 72/1, 405.01, 405.09, 72/405.11–405.16

[56] References Cited

U.S. PATENT DOCUMENTS 4,133,199 1/1979 Shirao ..... 72/405.16

4,540,087 9/1985 Mizumoto ..... 72/405.16

FOREIGN PATENT DOCUMENTS 63-47525 9/1988 Japan .

6-218459 8/1994 Japan .

6-262280 9/1994 Japan .

7-275971 10/1995 Japan .

*Primary Examiner*—Daniel C. Crane

*Attorney, Agent, or Firm*—Armstrong, Westerman, Hattori, McLeland & Naughton

[57] ABSTRACT

If a fault occurs in a servo driving system incorporated in a transfer system, the transfer system is continuously driven or safely stopped without loosing synchronization of the transfer system with a pass system. The transfer system is driven by a plurality of independently controllable servo motors $12_1$ to $12_n$. In the event that a driver for any one of the servo motors is failed for example, transmission of driving force to the servo motor associated the failed driver is interrupted by a magnet conductor in response to a specified signal indicative of a driver failure so that the servo motor can be brought into a free state.

7 Claims, 5 Drawing Sheets

TRANSFER PRESS

This application is a 371 of PCT/JP97/00048, filed Jan. 8, 1997.

TECHNICAL FIELD

The present invention relates to a transfer press and more particularly to a transfer press comprising a transfer system for transferring workpieces to be pressed.

BACKGROUND OF THE INVENTION

There are known transfer presses which include a transfer system for conveying workpieces to be pressed through a series of work stations in timed relation with performance of a series of pressing operations. Typically, the transfer system comprises a pair of feed bars juxtaposed so as to extend in a workpiece transferring direction and cross bars each spanned between these feed bars. The transfer system conveys workpieces held by vacuum caps by vacuum adsorption, these vacuum caps being attached to the cross bars. Alternatively, the transfer system conveys workpieces gripped at both sides by fingers attached to the feed bars. In this case, the pair of feed bars perform two-dimensional or three-dimensional movement to transfer an individual workpiece from one station where a set of dies are disposed to the next adjacent station where another set of dies are disposed.

The most typical method for driving the feed bars is a mechanical driving method in which the feed bars are driven, being linked to the press system with a cam and link mechanism. This method however reveals the disadvantage that adjustment at the time of die replacement is extremely difficult and therefore the individual driving method becomes prevailing recently according to which the feed bars are driven with motors (servo motors) different from the motor for the press system. Such transfer presses having a transfer system driven by the individual driving method has the advantage that the transfer system can be changed arbitrarily in its movement and has a simple configuration.

In the transfer press of this type, the transfer system is driven synchronously with the movement of the press slide and is designed to move, drawing a motional trajectory in which interference does not occur between the cross bars etc. of the transfer system and the dies. If a failure occurs in the servo driving systems (e.g., servo amplifiers) during operation of the transfer system, the control of the servo motors cannot be continued. The measure usually taken in the even of such a failure is such that the servo driving systems are disconnected from the servo motors by means of hard logic and then the servo motors are D.C. braked thereby stopping the servo motors immediately. Meanwhile, the press slide of the press system is brought to an emergency stop, by being braked upon detection of a failure in the transfer system. In this way, the press system and the transfer system are independently stopped in the event that a failure occurs in the servo driving systems of the transfer system.

As far as the press slide and the transfer system can be stopped simultaneously in the event of a failure in the transfer system, there is no problem. However, in reality, the transfer system is stopped before a stop of the press slide because the inertia force of the press slide is much greater than that of the transfer system. If the transfer system deflects from the set course of feeding motion during stopping or stops at a wrong position in the case of emergency stop, there will be the danger that the press slide crashes to the transfer system because of the inertia of the press slide, thereby damaging the press dies or transfer system which are very expensive.

In cases where the transfer press is installed in the production line for automobiles for example, the pressing line is situated in the upstream of the welding, painting and assembly lines and therefore the emergency stop of the pressing line would involve and cause a trouble to the overall production line.

The present invention is directed to overcoming the foregoing problems and it is therefore one of the objects of the invention to provide a transfer press which can be continuously driven or safely stopped without loosing synchronization of the transfer system with the press system in the event of a failure in the servo driving systems of the transfer system.

DISCLOSURE OF THE INVENTION

The above object can be accomplished by a transfer press according to the invention comprising a transfer system for transferring workpieces to be pressed, in which the transfer system is driven with a plurality of independently controllable servo motors, and which further comprises free state controlling means for interrupting, in response to a specified signal indicative of at least one of the servo motors, transmission of driving force to the indicated servo motor to bring the indicated servo motor into a free state.

According to the invention, the transfer system is driven by a plurality of servo motors which are independently controllable, so that if one of the servo motors becomes inoperable, the inoperable servo motor is released into a free state and other servo motors continuously drive the transfer system, backing up the inoperable servo motor. Accordingly, the transfer system can be driven in timed relation with the operation of the press system to ensure synchronization of the transfer system with the press system. With this arrangement, even if the dies installed in the press system are in descending movement, the transfer system can be stopped after synchronous driving or driven for emergency operation only with the presently operable servo motors without causing interference between the dies and the cross bars or finger bars of the transfer system.

In the invention, the specified signal is a fault detection signal indicative of detection of a fault in any one of driving systems for the servo motors and the free state controlling means brings, the servo motor associated with the driving system in which a fault has been detected, into a free state. With this arrangement, even if a fault occurs in the driving system (e.g., servo amplifier) for one of the plurality of servo motors, the servo motor associated with the failed driving system can be brought into a free state while the transfer system is continuously driven by the normal servo motors to maintain synchronization of the transfer system with the press system, so that the transfer system can be safely stopped in synchronization with a stop of the press system or can be driven for emergency operation only with the normal servo motors.

The specified signal may be an invalid drive bar setting signal input from outside for setting an invalid drive bar and the free state controlling means brings, the servo motor operated by the driving system corresponding to the set invalid drive bar, into a free state. With this arrangement, even if a fault occurs in the servo driving system (e.g. servo amplifier) for any one of the plurality of servo motors, a measure for emergency operation can be taken to continuously drive the transfer system by means of the normal servo motors while ensuring synchronization of the transfer system with the press system, by setting the drive bar corresponding to the failed servo driving system as an invalid drive bar.

The free state controlling means may disconnect first connection means interposed between the indicated servo motor and its associated servo amplifier and disconnect second connection means interposed between the indicated servo motor and its brake unit, whereby the indicated servo motor can be brought into a free state.

Preferably, the transfer press according to the invention further comprises stop controlling means for stopping all the servo motors in response to a stop request signal. In this case, the stop request signal may be issued upon occurrence of faults in a plurality of drive bars or in the event of a fault requiring an emergency stop. The stop controlling means may disconnect first connection means interposed between each of the servo motors and its associated servo amplifier and connect second connection means interposed between each of the servo motors and its brake unit, whereby all the servo motors can be stopped.

BEST MODE FOR CARRYING OUT THE INVENTION

Figure 1:
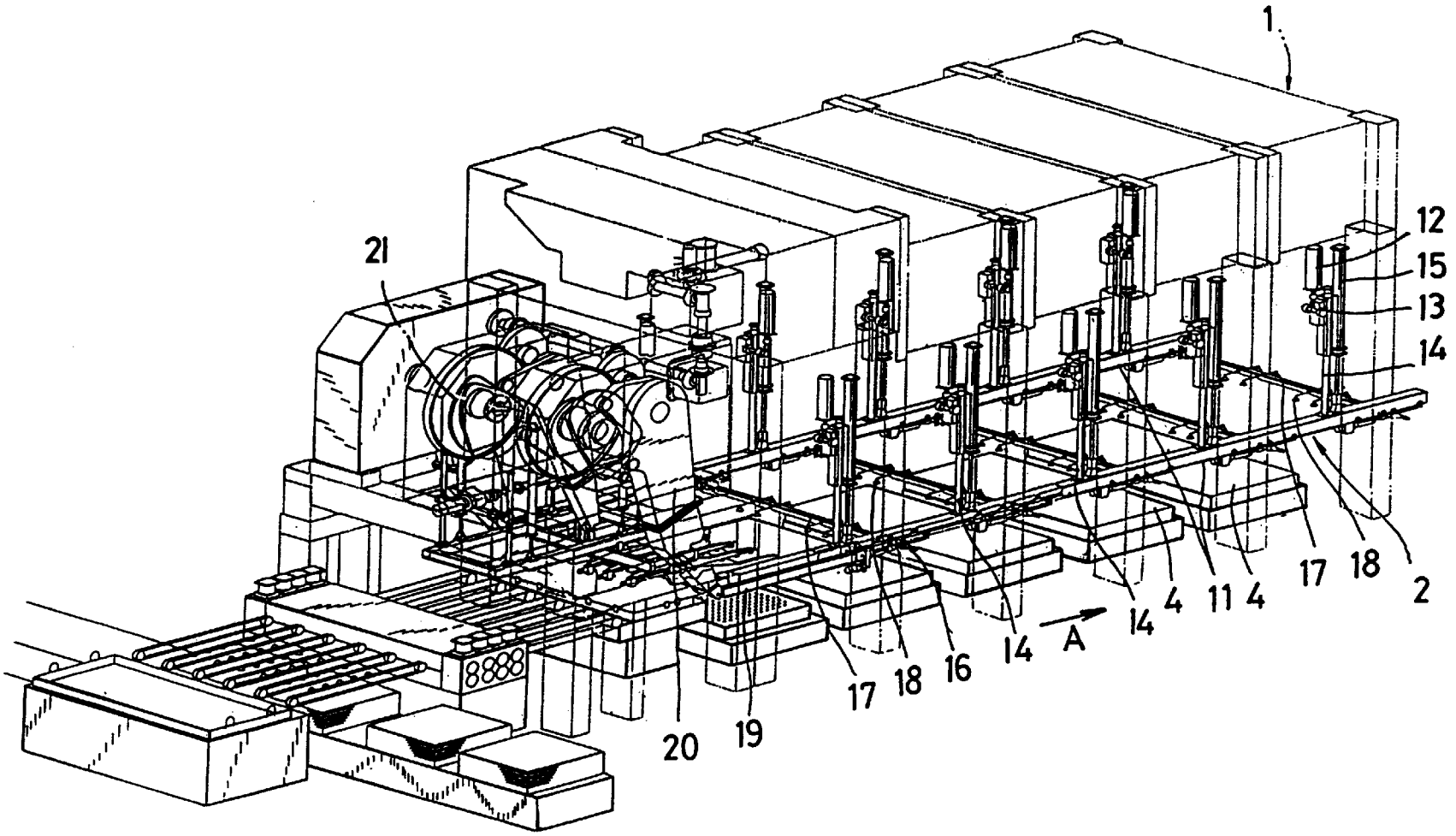
FIG. 1 is a schematic general perspective view of a transfer press according to one embodiment of the invention.

Referring now to the drawings, a transfer press constructed according to a preferred embodiment of the invention will be hereinafter described.

Figure 2:
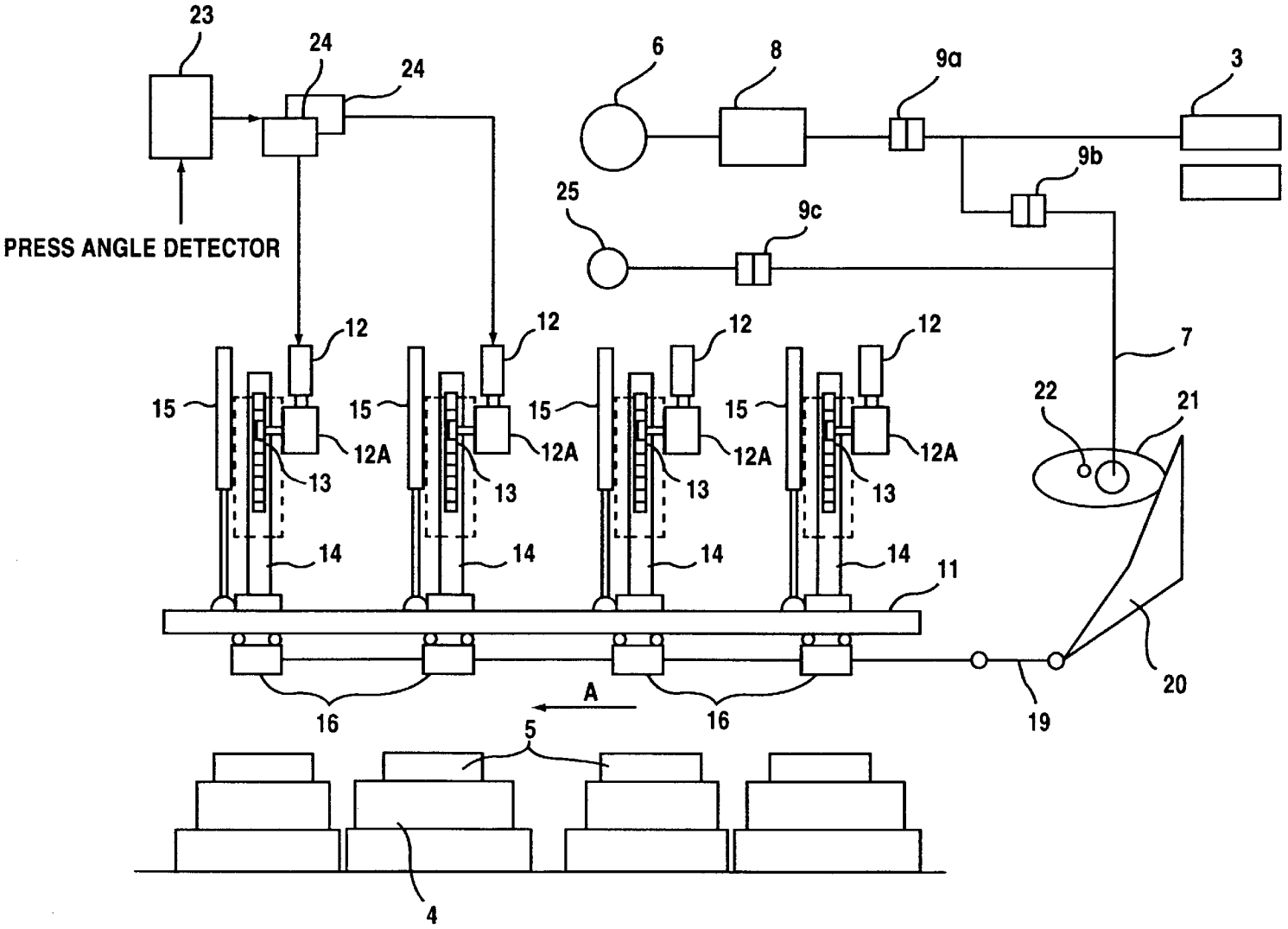
FIG. 2 diagrammatically depicts the system structure of the transfer press according to the embodiment.

FIG. 1 schematically depicts a general, perspective view of a transfer press constructed according to one embodiment of the invention, and FIG. 2 diagrammatically depicts the system structure of this transfer press. As shown in FIG. 1, the transfer press according to this embodiment comprises a press system 1 and a transfer system 2. The press system 1 has a series of work stations which perform successive pressing operations on each workpiece (not shown) whereas the transfer system 2 is disposed within the press system 1, for transferring the workpieces in the feeding direction A.

The press system 1 includes a press slide 3 which is reciprocable vertically by slide driving mechanisms spanned at the respective work stations. Upper dies are attached to the underside of the press slide 3 while lower dies are so attached to moving bolsters 4 as to respectively face their corresponding upper dies so that pressing operations can be performed on the respective workpieces placed between these dies. Each of the slide driving mechanisms comprises a main motor 6 controlled according to signals from a press controller; a drive shaft 7 driven by the main motor 6; a flywheel unit 8 attached to the drive shaft 7; clutches 9*a*, 9*b*; and a brake (not shown).

The transfer system 2 has a pair of feed bars 11 juxtaposed so as to extend along the workpiece feeding direction A, being suspended from above by means of lift mechanisms attached to the press system 1. Each lift mechanism includes a pinion 13 rotated by a servo motor 12 through reduction gears 12A and a rack bar 14 which meshes with the pinion 13. The feed bars 11 are supported at the respective lower ends of the rack bars 14 and driven by the servo motors 12 so as to move vertically in synchronous relation with the movement of the press system 1. Balance cylinders 15 are disposed at positions adjacent the respective rack bars 14, for maintaining a balance between the fluid pressure imposed on each balance cylinder 15 and the weight of the feed bars 11 etc. In this embodiment, five servo motors 12 are aligned at equal intervals on both sides so that the ten servo motors 12, in total, cooperate to lift or lower the pair of feed bars 11.

Supported on the undersides of the feed bars 11 are a plurality of cross bar carriers 16 which are spaced in the feeding direction A so as to be movable both in the feeding direction A and in the direction opposite to the feeding direction A. A cross bar 17 is spanned between each opposing pair of cross bar carriers 16 so as to extend in a direction perpendicular to the feeding direction A. The cross bars 17 respectively have vacuum cups 18 attached thereto for adsorbing the workpieces.

The cross bar carriers 16 adjacent to each other in the feeding direction A are coupled to each other by a coupling rod so that all the cross bar carriers 16 can simultaneously move both in the feeding direction A and in the direction opposite thereto. The most upstream cross bar carrier 16 attached to each feed bar 11 is connected to the distal end of each cam lever 20 by means of a coupling rod 19. The base end of each cam lever 20 adjoins to a feed cam 21 which is rotatable by power delivered from the press system 1. The rotation of the feed cams 21 brings the cam levers 20 in rocking movement thereby moving the cross bar carriers 16 both in the feeding direction A and in the direction opposite thereto.

The angle of rotation of each drive shaft 7 is detected by a press angle detector (cam angle detector) 22 and according to this detected press angle, each servo motor 12 is controlled by a transfer system controller 23 through its servo amplifier (servo driver) 24. With this arrangement, the cross bar carriers 16 of the transfer system 2 reciprocate in the feeding direction A and in the direction opposite thereto synchronously with the movement of the press system 1 so that the vacuum cups 18 attached to the cross bars 17 successively transfer the adsorbed workpieces to the respective work stations.

There is provided a single motor 25 for independently driving the transfer system 2, and each drive shaft 7 is also driven by the single motor 25 through a clutch 9*c*.

Figure 3:
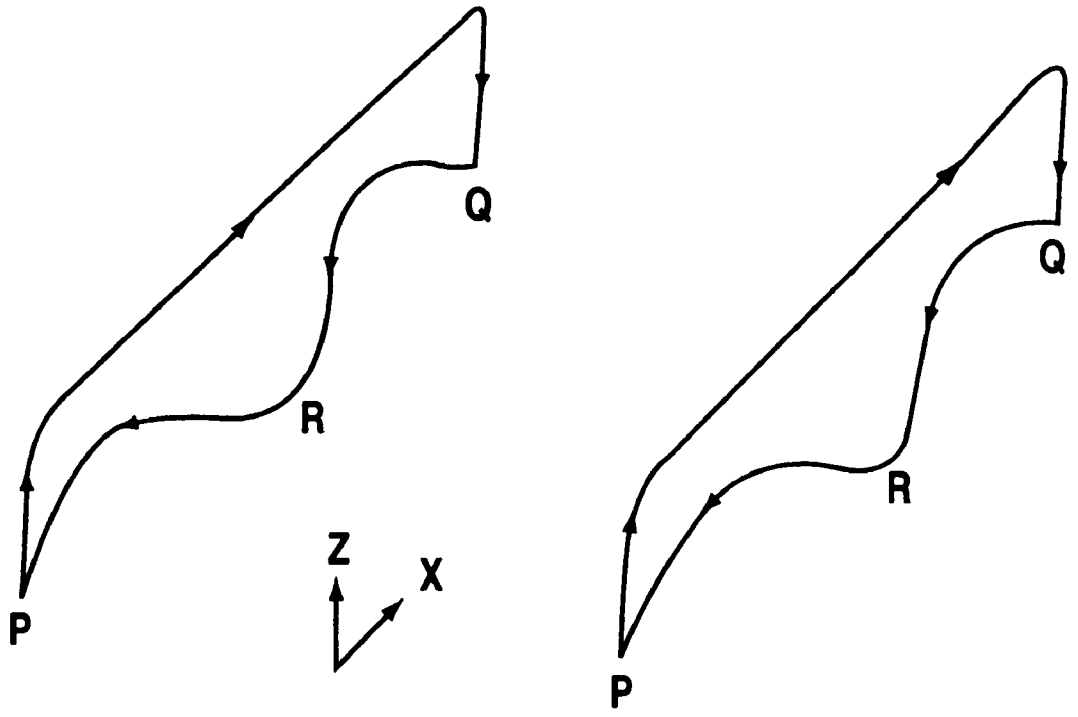
FIG. 3 depicts an example of the motion pattern of a transfer system.

The transfer system 2 is driven according to a specified motion pattern in order to avoid the interference between the dies and the workpieces being transferred by the transfer system 2. FIG. 3 shows a two-dimensional motion pattern as one example of this motion pattern. According to this example, for moving onto the lower die of the previous work station, the transfer system 2 is first lifted at the standby point R, and then moved to and lowered at the adsorbing point P. At the adsorbing point P, the transfer system 2 adsorbs the workpiece to lift out of the lower die of the previous work station in the direction of Z axis and then conveys it in the direction of X axis to the position above the lower die of the next work station. To place the workpiece in this lower die, the transfer system 2 is lowered to release the workpiece at the releasing point Q. After releasing, the transfer system 2 is lifted and then moved back downwardly to the stand-by point R thereby terminating one cycle.

Figure 4:
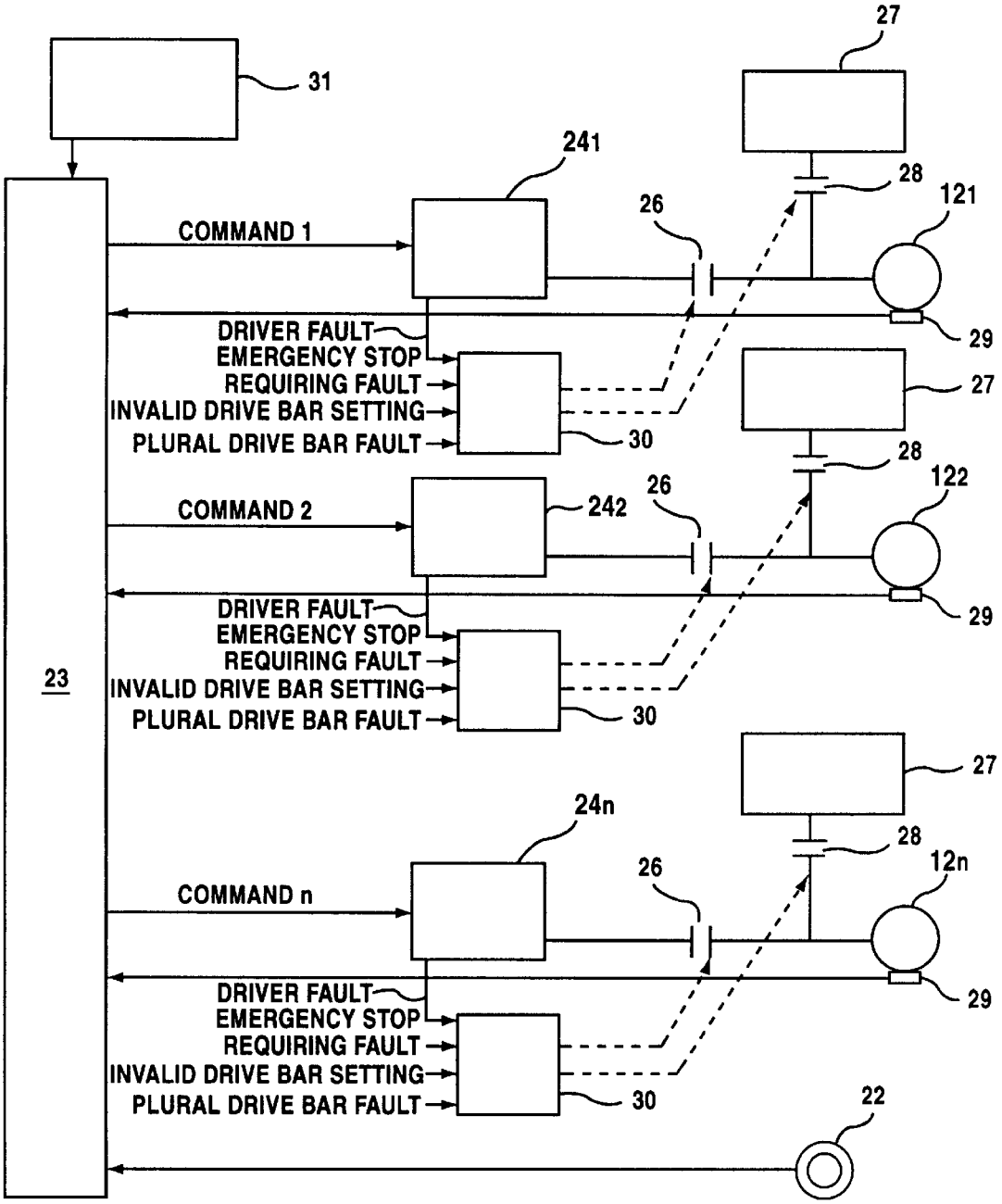
FIG. 4 is a block diagram of a control system for servo systems.

Next, reference is made to FIG. 4 to describe a control system for the servo systems constructed according to the embodiment. As seen from FIG. 4, a magnet conductor 26 is interposed between the respective servo motors $\mathbf{12}_1$ to $\mathbf{12}_n$ for driving each drive bar (rack bar 14) and the respective servo amplifiers $24_1$ to $24_n$ for driving each servo motor 12 by controlling a current supplied to each servo motor 12. A magnet conductor 28 is interposed between the respective servo motors $12_1$ to $12_n$ and their respective brake units 27 for bringing each servo motor 12 to an emergency stop. As these brake units 27, d.c. power sources or regenerative resistors may be used. The servo motors $12_1$ to $12_n$ are respectively provided with a position sensor 29 for detecting the present position of each servo motor 12. Positional signals issued by the position sensors 29 are input in the transfer system controller 23. The transfer system controller 23 calculates the difference between the present positional data on each servo motor 12 input from each position sensor 29 and press angle data on each servo motor 12 input from the press angle detector 22 and generates movement commands 1 to n so as to make each difference be zero and outputs these commands 1 to n to the servo motors $12_1$ to $12_n$ via their servo amplifiers $24_1$ to $24_n$.

The magnet conductors 26, 28 are switched between a connecting state and a disconnecting state by hard logic 30 provided for each servo amplifier 24. To perform this switching control, each hard logic 30 is supplied with a driver fault signal, emergency stop requiring fault signal, or invalid motor signal upon occurrence of a fault in the servo amplifiers 24 or a fault in the transfer system controller 23 (NC fault). More specifically, the emergency stop requiring fault signal is issued upon detection of a fatal fault such as an overrun or uncontrollable state of the transfer system controller 23. The driver fault signal and the invalid motor signal are issued in order to allow the transfer system controller 23 to forcibly stop desired servo motor(s) 12. The driver fault signal is issued by the transfer system controller 23 which determines possible interference based on data representative of the present position of each servo motor 12 input from its position sensor 29. The invalid motor signal is supplied to the transfer system controller 23 based on data on an invalid drive bar which has been set through a data setting console 31. Setting of an invalid drive bar is effected for example when a certain servo amplifier 24 is failed and emergency production needs to be carried out only with the remaining normal servo amplifiers 24.

Figure 5:
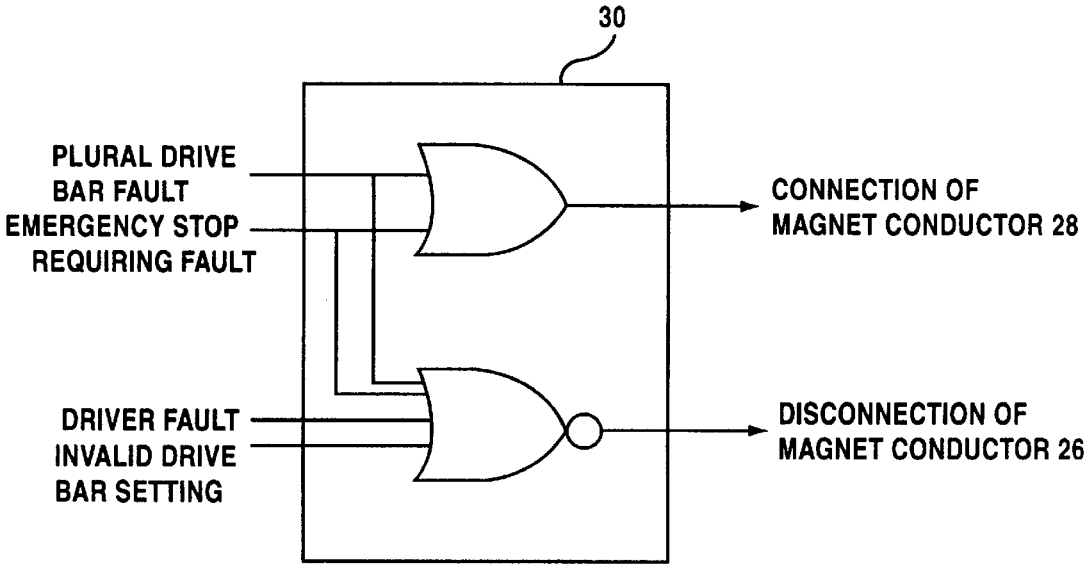
FIG. 5 depicts the configuration of hard logic.

As seen from FIG. 5, the hard logic 30 is designed such that, if a request for a stop is released from the transfer system controller 23 upon occurrence of faults in a plurality of drive bars or if a fault requiring an emergency stop occurs, the hard logic 30 allows the magnet conductors 28 to be turned on to connect the servo motors 12 to their brake units 27 thereby stopping the servo motors 12. Upon occurrence of faults in a plurality of drive bars, an emergency stop requiring fault or a driver fault, or upon setting of an invalid drive bar, the hard logic 30 allows the magnet conductor(s) 26 to be turned on thereby disconnecting the servo motor(s) 12 from the servo amplifier(s) 24. It should be noted that when the magnet conductors 26 and 28 are both disconnected, the associated servo motor 12 is in a free running condition (torque free condition).

According to this embodiment, in the event that there occurs a fault in one of a plurality of servo amplifiers $24_1$ to $24_n$ during operation of the transfer system 2 and the failed servo amplifier becomes inoperable, the magnet conductor 26 corresponding to the failed servo amplifier is disconnected to bring the servo motor into a free state while the operation of the transfer system 2 is continued with the remaining operable servo motors backing up the failed servo motor. With this arrangement, the transfer system 2 can be driven in timed relation with the operation of the press system 1, ensuring synchronization of the transfer system 2 with the press system 1. Accordingly, when the press system 1 stops, the transfer system 2 can be securely brought to a stop synchronously to the stop action of the press system 1.

In the event that two or more servo amplifiers are failed, the load on the servo motors corresponding to the remaining normal servo amplifiers increases, so that there is the danger that all the servo motors would be brought into a free state in a fashion like a chain reaction. To avoid such a risk, when two or more servo amplifiers are failed (i.e., faults in a plurality of drive bars), a plural drive bar fault signal is released so that all the magnet conductors 28 are connected to stop all the drive bars for emergency.

Additionally, in cases there is a need to produce products urgently in spite of a failure in one of the servo amplifiers, the invalid drive bar is set through the data setting console 31 to input to the transfer system controller 23, whereby the servo motor corresponding to the invalid drive bar can be disconnected from its servo amplifier 24 to perform emergency operation only with the remaining normal servo amplifiers 24.

I claim:

1. A transfer press comprising:

a transfer system for transferring workpieces to be pressed, in which said transfer system is driven with a plurality of independently controllable servo motors;

a signal indicating means for generating a specified signal indicative of at least one of the servo motors; and a free state controlling means for interrupting, in response to a specified signal indicative of at least one of the servo motors generated by said signal indicating means, transmission of driving force to the indicated servo motor to bring the indicated servo motor into a free state.

2. A transfer press comprising:

a plurality of independently controllable servo motors;

a signal indicating means for generating a specified signal indicative of at least one of the servo motors; and a free state controlling means for interrupting, in response to a specified signal indicative of at least one of the servo motors generated by said signal indicating means, transmission of driving force to the indicated servo motor to bring the indicated servo motor into a free state, wherein said signal indicating means generates a fault detection signal that is indicative of detection of a fault in any one of driving systems for the servo motors and the free state controlling means brings the servo motor associated with the driving system in which a fault has been detected into a free state.

3. A transfer press according to claim 1, wherein said signal indicating means generates an invalid drive bar setting signal input from outside for setting an invalid drive bar and the free state controlling means brings the servo motor operated by the driving system corresponding to the set invalid drive bar into a free state.

4. A transfer press according to claim 1, 2 or 3, wherein each servo motor is coupled to an associated amplifier for amplifying the driving force transmitted to its respective servo motor, and a brake unit for stopping its respective servo motor, wherein said free state controlling means includes a first connection means interposed between said indicated servo motor and its associated servo amplifier and, a second connection means interposed between said indicated servo motor and its associated brake unit, and wherein said free state controlling means disconnects said first and second connection means thereby bringing said indicated servo motor into a free state.

5. A transfer press according to claim 1, further comprising stop controlling means for stopping all the servo motors in response to a stop request signal generated by said signal indicating means.

6. A transfer press according to claim 5, wherein said stop request signal is generated in the event a plurality of drive bars are failed or in the event a fault requiring an emergency stop occurs.

7. A transfer press according to claim 5 or 6, wherein each servo motor is coupled to an associated amplifier for amplifying the driving force transmitted to its respective servo motor, and a brake unit for stopping its respective servo motor, wherein said stop controlling means includes a first connection means interposed between each of the servo motors and its associated servo amplifier and a second connection means interposed between each of the servo motors and its brake unit, and wherein said stop controlling means disconnects said first connection means and connects said second connection means thereby bringing all the servo motors to a stop.

* * * * *